US006484008B2

(12) United States Patent
Arcaro et al.

(10) Patent No.: US 6,484,008 B2
(45) Date of Patent: Nov. 19, 2002

(54) RECIRCULATING TYPE PAPER DRIVE FOR A DIRECT TRANSFER COLOR PRINTER

(75) Inventors: David J. Arcaro, Boise, ID (US); Wayne E. Foote, Eagle, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/746,937

(22) Filed: Dec. 19, 2000

(65) Prior Publication Data

US 2002/0076242 A1 Jun. 20, 2002

(51) Int. Cl.[7] ..... G03G 15/00
(52) U.S. Cl. ..... 399/301; 394/395
(58) Field of Search ..... 271/248, 250, 271/252; 347/153; 399/167, 301, 394, 395, 388

(56) References Cited

U.S. PATENT DOCUMENTS 5,339,136 A * 8/1994 Parsons et al. ..... 399/301
5,462,373 A 10/1995 Chia ..... 400/62.4
5,978,642 A 11/1999 Arcaro et al. ..... 399/381
6,118,465 A 9/2000 Arcaro et al. ..... 347/153
6,137,989 A * 10/2000 Quesnel ..... 399/394

* cited by examiner

*Primary Examiner*—Hoang Ngo

(57) ABSTRACT

A paper drive sheet feeder system includes an edge guide, a paper transport mechanism, a paper edge detector, and control circuitry. The edge guide serves to guide the edges of a sheet of paper along a travel path of a peripheral device. The paper transport mechanism is configured to move the sheet of paper along the travel path. The paper edge detector is provided along the travel path to detect a leading edge of the sheet of paper. The control circuitry communicates with the paper transport mechanism and the paper edge detector and is operative to locate the sheet of paper in response to the detected leading edge of the sheet of paper along the travel path to accurately superpose successive image planes during a multiple color image transfer process. A printing system and a method are also provided.

19 Claims, 3 Drawing Sheets

RECIRCULATING TYPE PAPER DRIVE FOR A DIRECT TRANSFER COLOR PRINTER

FIELD OF THE INVENTION

This invention pertains to color printing. More particularly, this invention relates to color laser printing systems and to image plane registration for color printing systems.

BACKGROUND OF THE INVENTION

Color image printing systems are known in the art. One color image printing system comprises an inkjet printer. An inkjet printer prints color images incrementally, with a continuous inkjet printing process, piezoelectric inkjet printing process or bubble-jet printing process. However, these inkjet printing processes provide relatively low-cost printing that is often satisfactory for printing color graphics images, but is not necessarily of high enough quality for certain business applications.

Another color image printing system comprises a color laser, or electrophotographic, printer. Color laser printers generate sufficient text and graphics quality for most business applications. However, color laser printers typically require complex and expensive mechanisms when forming and aligning overlaid color frames. Hence, color laser printers are not sufficiently economical for many applications.

One problem encountered with color laser printers relates to registration of individual color image planes that generate a printed color page. A color image plane is an arrangement either in electronic or optical or other physical form representing a distinctive image in one color. One physical form comprises a single color of toner particles. Typically, three or four distinct color image planes are imaged using one of several known techniques and transferred onto a common piece of paper in order to generate a color image. In some cases, a yellow, a magenta and a cyan color image plane are each imaged and transferred onto a common piece of paper. In other cases, a black, a yellow, a magenta and a cyan color image plane are each imaged and transferred. Irrespective of whether individual color image planes are serially or concurrently transferred onto a piece of paper, registration of individual color image planes is very important.

One type of color image printing system builds up four different colored image planes onto a well-controlled substrate before transferring the generated image onto a piece of paper. One exemplary printing system comprises a Hewlett-Packard Color LaserJet 5, manufactured by Hewlett-Packard Co. of Palo Alto, Calif. Such exemplary printing system builds up a color image onto a page size photoconductor drum. The generated image comprises four distinct colors: yellow, magenta, cyan and black. Four developers are used to produce the four colors, with four distinct photoconductor drum rotations being needed to accumulate the four-color toner images.

Another exemplary printing system comprises a Tektronix Phaser 560, manufactured by Tektronix of Wilsonville, Oreg. Such exemplary printing system builds up a color image onto a page size intermediate transfer medium. However, the use of an intermediate transfer medium adds an additional processing step, which increases cost and complexity. Yet another type of color image printing system comprises a Xerox C55 color laser printer. Such laser printer fixes a sheet of paper onto a drum in order to achieve plane-to-plane registration of successively colored image planes.

Each of the above-mentioned printing systems increases the size of the printer or increases the complexity or cost of the printer. Therefore, there exists a need to provide a reduced cost and complexity technique for achieving a multiple pass color laser printer that realizes improved plane-to-plane registration and is usable with a wide range of media types.

SUMMARY OF THE INVENTION

A recirculating type paper drive provides a relatively low cost technique for achieving a multiple pass color laser printer having excellent planeto-plane registration and usable with a wide range of media types. According to one implementation, a four pass color laser printer achieves improved registration for most types of printable paper.

According to one aspect, a paper drive sheet feeder system includes an edge guide, a paper transport mechanism, a paper edge detector, and control circuitry. The edge guide cooperates with the paper transport mechanism to guide the edge of a sheet of paper along a travel path of a peripheral device. The paper transport mechanism is configured to move the sheet of paper along the travel path. The paper edge detector is provided along the travel path to detect the leading edge of the sheet of paper. The control circuitry communicates with the paper transport mechanism and the paper edge detector and is operative to locate the sheet of paper in response to the detected leading edge of the sheet of paper along the travel path to accurately superpose successive image planes during a multiple color image transfer process.

According to another aspect, a printing system is provided for printing multiple colors on a sheet of print media. The printing system includes an electrophotographic print engine and a paper drive sheet feeder system. The electrophotographic print engine includes a photoconductor drum and a transfer roller configured to interact in co-rotation with the drum during transfer of a color image plane from the drum onto a sheet of print media passed therebetween. The paper drive sheet feeder system includes at least one edge guide, a sheet transport mechanism, a sheet edge detector, and control circuitry. The edge guide is configured to guide an edge of the sheet of print media along a travel path about the print engine. The sheet transport mechanism is configured to move the sheet of print media along the travel path. The sheet edge detector is provided along the travel path to detect the leading edge of the sheet of print media. The control circuitry communicates with the sheet transport mechanism and the sheet edge detector and is operative to locate the sheet of print media in response to the detected leading edge of the sheet of print media along the travel path to accurately superpose successive image planes during a multiple color image transfer process.

According to yet another aspect, a method is provided for aligning and positioning a sheet of print media to receive multiple, successive color image planes. The method includes: moving a sheet of print media along a travel path; while moving the sheet of print media along the travel path, accurately guiding the sheet of print media along an edge guide to prevent movement in a lateral direction; detecting the leading edge of the sheet of print media to accurately locate positioning of the sheet of print media along the travel path; while moving the accurately located sheet of print media, transferring a first color image onto the sheet of print media; moving and accurately guiding the sheet of print media along the travel path along the guide and about a print engine; following transferring the first color image and moving the sheet, detecting the leading edge of the sheet of print media to accurately locate positioning of the sheet of print media along the travel path; and while moving the accurately located sheet of print media, transferring a second color image onto the sheet of print media accurately aligned atop the first color image.

One advantage is provided by precisely transferring a sheet of print media between successive passes against a photoconductor drum while transferring successive color image planes onto the sheet of print media so as to ensure precise registration between successive color image planes when forming an image.

Other features and advantages of the invention will become apparent to those of ordinary skill in the art upon review of the following detailed description, claims, and drawings.

DESCRIPTION OF THE DRAWINGS

Preferred embodiments of the invention are described below with reference to the following accompanying drawings depicting examples embodying the best mode for practicing the invention.

DETAILED DESCRIPTION OF THE INVENTION

This disclosure of the invention is submitted in furtherance of the constitutional purposes of the U.S. Patent Laws "to promote the progress of science and useful arts". U.S. Constitution, Article 1, Section 8.

Figure 1:
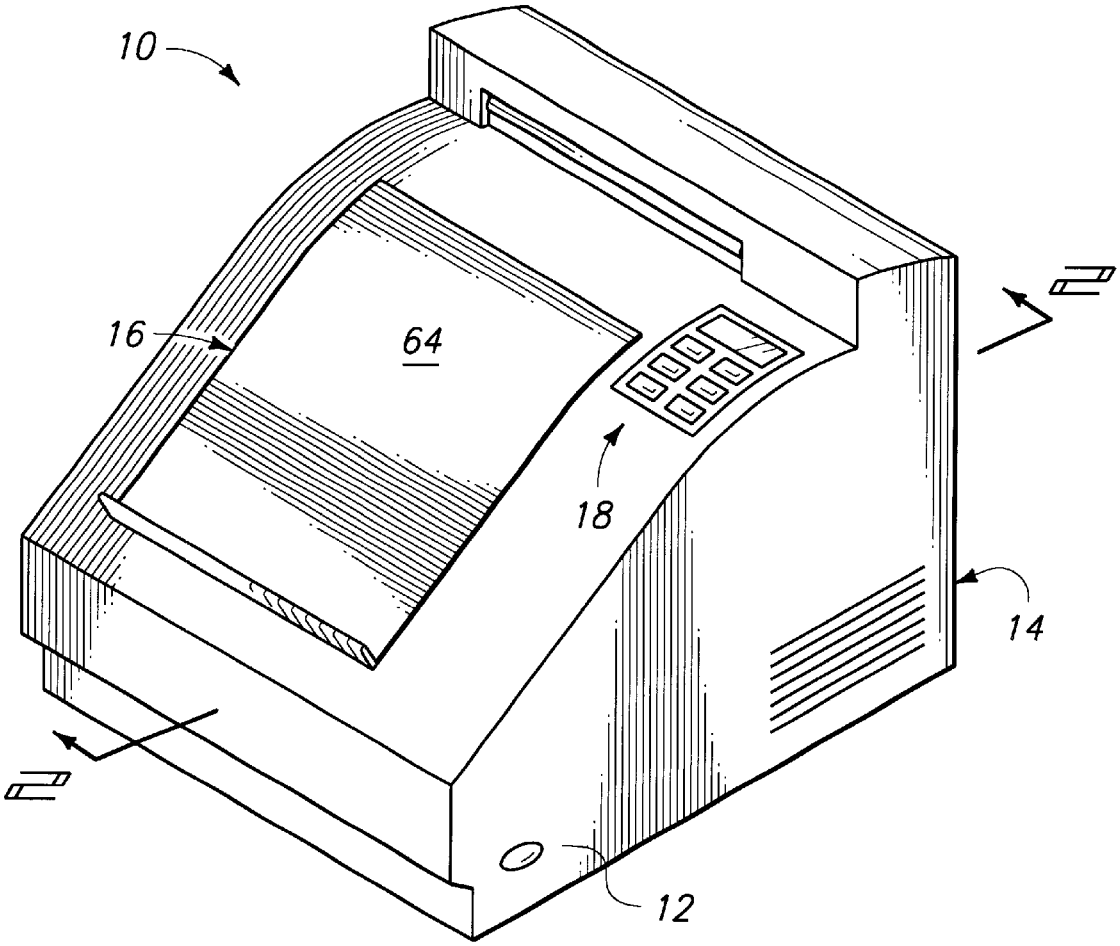
FIG. 1 is a perspective view of a printing system in accordance with one embodiment of Applicant's invention.

FIG. 1 shows a printing system 10 embodying Applicant's invention usable for printing color images onto a sheet or page of print media, such as a sheet of paper. Typically, printing system 10 is connected for control with a microprocessor-based computer (not shown). Printing system 10 comprises an electrophotographic printer configured to print monochrome and/or color images onto a sheet. As shown in FIG. 1, color laser printer 10 includes a housing 12, a paper tray 14, an output tray 16 and a user interface 18. User interface 18 includes one or more of a keyboard, a display, and a keypad that enables a user to operate and/or configure printer 10.

As shown in FIG. 1, according to one implementation color laser printer 10 is configured to generate four different, successively transferred colored image planes. The image planes cooperate to form an image. Alternatively, printer 10 can be configured to compose at least three different colored image planes. Even further alternatively, printer 10 can be configured to compose two different colored image planes. Optionally, such printer 10 can be used to generate a plurality of different or uniquely shaded image planes, each having a unique shade of a common color, such as two unique and distinguishable grey-scale image planes.

Irrespective of the total number of image planes, the ability to align such planes to one another is important to achieving precise color printing of a colored image. As used herein, the term "color printing" is understood to include the generation and transfer of a plurality of unique shades of a common color, or of different grey-scale image planes.

Figure 2:
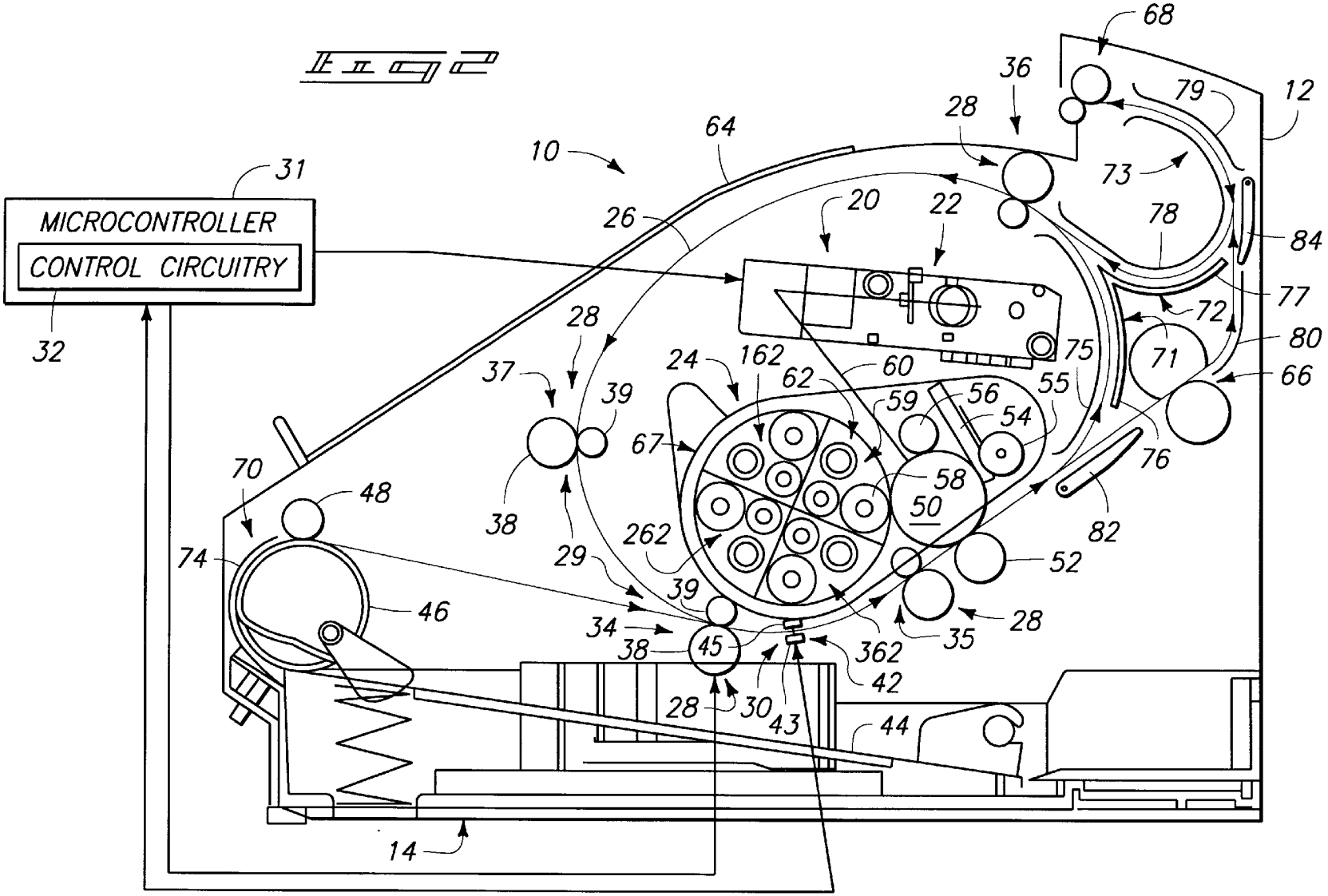
FIG. 2 is a vertical sectional view of the printing system of FIG. 1 taken along line 2—2.

FIG. 2 illustrates recirculating type paper drive color laser printer 10 in vertical sectional view to enable description of internal operating components. As shown in FIG. 2, a recirculating paper travel path 26 is depicted within printer 10, extending between a plurality of roller transport assemblies 34–37 each including an edge guide roller 39 which cooperates with a paper drive roller 38 to provide a paper transport mechanism 28. Each pair of rollers 38–39 cooperate to provide an edge guide 29. It is understood that assemblies 34–37 each include a pair of coacting rollers 38, 39 provided along one lateral edge of travel path 26. As shown in FIG. 2, travel path 26 encircles print engine 20, including laser scanner 22 and toner cartridge 24.

Paper transport mechanism 28 moves a sheet 64 of paper along recirculating paper travel path 26 to provide a recirculating-type paper drive for a direct transfer color laser printer 10. Accordingly, printer 10 comprises a recirculating-type paper drive configured to achieve a four-pass color printing process in a relatively low cost manner and having accurate plane-to-plane registration between color image planes. Furthermore, such recirculating-type paper drive is compatible with a relatively wide range of media types, such as various thicknesses of sheet 64.

In order to accurately detect the positioning of a sheet 64 of paper along path 26, a paper edge detector 30 is provided. Paper edge detector 30 is configured to accurately detect a leading edge of sheet 64 as sheet 64 is delivered along paper travel path 26. According to one alternative construction, a trailing edge of sheet 64 can be detected via detector 30. A microcontroller 31 communicates with paper edge detector 30 and paper transport mechanism 28 to provide a feedback control system operative to precisely move sheet 64 along the direction of travel path 26 during a multiple stage printing operation. More particularly, paper edge detector 30 comprises a precise slot photointerruptor 42 including a light source, or photodiode, 45 and an optical detector, or photodetector, 43 which are aligned such that sheet 64 interrupts detection of the light with the optical detector 43.

Accordingly, movement of a sheet 64 of paper through photointerrupter 42 causes a change in output state for the optical detector 43. Detection of such change of state enables a precise determination of the location of a leading edge of the sheet 64 of paper along travel path 26. In response to receiving an output signal from photointerruptor 42, microcontroller 31 generates a control signal that activates and deactivates paper transport mechanism 28 to move sheet 64 along path 26 in response to detected positioning of sheet 64 relative to precise slot photointerruptor 42.

Roller 39 cooperates with paper drive roller 38 within each roller transport assembly 34–37 to precisely guide a sheet 64 of paper along paper travel path 26 in order to further ensure accurate registration between successive images that are printed onto sheet 64 using printer 10. Roller 39 is skewed to guide a sheet of paper along a lateral edge. The construction of skew rollers is presently understood in the art. One exemplary construction for edge guide skew rollers is described in U.S. Pat. No. 6,118,465, assigned to Hewlett-Packard Company, and herein incorporated by reference. Hence, roller 39 cooperates with paper transport mechanism 28, paper edge detector 30, and microcontroller 31 to accurately move and present a sheet 64 of paper along paper travel path 26 and accurately transfer and superpose successive color image planes during a multiple color image transfer process.

Paper edge detector 30 provides an input to control circuitry 32 in order to regulate positioning of sheet 64 by regulating the drive signal for each paper drive roller of each assembly 34–37 of paper transport mechanism 28. According to a color printing configuration, color laser printer 10 comprises at least three, and usually four, different color image planes. The alignment of these color image planes to one another is critical in order to achieve a resulting quality image on sheet 64. Even slight variations between registration of different color image planes can result in hue and density shifts throughout the image that is printed onto the sheet 64 of paper.

In operation, individual sheets of paper are retrieved from a pressure plate 44 of a paper tray 14 via a pick roller 46. A single sheet 64 of paper is then transferred between pick roller 46 and a transfer, or guide, roller 48 and deposited at roller transport assembly 34, at a nip between edge guide skew roller 39 and paper drive roller 38. Each paper drive 38 of assemblies 34–37 comprises a single, high friction elastomeric roller. Paper drive roller 38 is rotatably actuated so as to deliver a single sheet 64 of paper into position between a photoconductor drum (or roller) 50 and a transfer roller 52 such that a first color image plane can be printed onto the sheet 64 of paper from drum 50. Accordingly, such sheet 64 of paper is presented between roller transport assembly 34 of roller 39 and paper drive roller 38 with roller transport assembly 34 driving sheet 64 through photointerruptor 42 and against photoconductor drum 50. Paper drive roller 38 is driven via a drive motor (not shown), under control of microcontroller 31 and in response to detected position along travel path 26, to accurately move sheet 64 of paper to receive a first image plane from photoconductor drum 50.

As shown in FIG. 2, microcontroller 31 delivers an output control signal to roller transport assembly 34. More particularly, microcontroller 31 delivers an output signal which drives rotation of paper drive roller 38 of roller transport assembly 34. Although not shown in FIG. 2, it is understood that a similar output signal is provided to roller 38 of each respective remaining roller transport assembly 35–37. Furthermore, according to one construction, each paper drive roller 38 is controllably driven using a high resolution stepper motor. According to one embodiment, a single high-resolution stepper motor is utilized to drive paper drive roller 38 of assembly 34, with the remaining paper drive rollers 38 being geared together with the paper drive roller 38 of assembly 34 via a gear train, a toothed belt, or a band drive (not shown). According to an alternative embodiment, each paper drive roller 38 is driven by a dedicated, high-resolution stepper motor. It is further understood that photoconductor drum 50 comprises an optical photoconductor roller including a high-resolution stepper motor. Accordingly, the utilization of high-resolution stepper motors in transport mechanism 28 and as a drive for photoconductor drum 50 ensures accurate image plane registration between successive color image planes as they are deposited onto a sheet 64 of paper.

Additionally, or alternatively, encoders can be provided on a drive for photoconductor drum 50, and in order to drive the paper drive rollers 38 of paper transport mechanism 28.

After transfer of the first image plane onto sheet 64 of paper, each drive roller 38 of roller transport assemblies 34–37 is driven to move sheet 64 in a forward, advancing direction along travel path 26. More particularly, sheet 64 is moved completely about so as to encircle print engine 20 until sheet 64 engages with assembly 34 and physically interrupts photointerruptor 42. Hence, sheet 64 is again accurately located. Roller transport assembly 34, along with the associated drive roller 38, controllably drives sheet 64 in response to detected positioning of sheet 64 using photointerruptor 42. Accordingly, sheet 64 is accurately advanced and positioned between photoconductor drum 50 and transfer roller 52 when delivering a subsequent image plane from drum 50 onto sheet 64. The resulting subsequent image plane is aligned in accurate registry atop the first image plane. The same technique is used to move sheet 64 forward along travel path 26 in order to deliver additional, successive image planes accurately atop previously delivered image planes, on a first side of sheet 64. Accordingly, subsequent additional color image planes are deposited onto drum 50, then transferred onto sheet 64 of paper via the above technique.

FIG. 2 illustrates the workings of an electrophotographic color laser printer 10. Laser scanner 22 is provided within printer 10 for generating an optical image via an imaging path or a slot 60 which is superposed onto photoconductor drum 50 after drum 50 has been charged with a charge roller 56. Subsequently, one of four different colored toners is delivered from one of toner developers 62, 162, 262 and 362.

Printer 10 is preferably connected for control with a microprocessor-based computer (not shown) which submits print jobs to printer 10. Printer 10 includes an electrophotographic printer that is configured to print a color image onto sheet 64, in the form of an image plane (e.g., including text and/or graphics). As used here, the term "image" is intended to mean text, graphics, or both text and graphics. One or more superposed image planes cooperate to provide a final image on sheet 64.

As shown in FIG. 2, printer 10 comprises a color laser printer. In one embodiment, printer 10 includes internal components similar to those found in a LaserJet 5000 printer sold by Hewlett-Packard Company of Palo Alto, Calif.

Printer 10 includes housing 1 2 configured to support internal operating components. In the illustrated embodiment, printer 10 includes laser scanner 22 supported in housing 12. A toner supply is contained within one of toner developers 62, 162, 262, and 362. A photoconductor drum 50 is provided which is acted upon by laser scanner 22. A charge roller 56 is provided in contact with photoconductor drum 50 to impart charge to drum 50 upstream of where laser scanner 22 acts on photoconductor drum 50. A developer roller 58 is provided in each of developers 62, 162, 262, and 362 which acts on the photoconductor drum 50 downstream from where the laser scanner 22 acts on photoconductor drum 50. A transfer roller 52 is provided at a location facing the photoconductor drum 50 downstream from the developer roller 58 and cooperating with the photoconductor drum 50 to impart an image onto sheet 64. A cleaning blade 54 is configured to clean photoconductor drum 50 within a waste toner reservoir (not identified) after the image has been imparted to sheet 64. Furthermore, a fuser 66 is provided spaced apart from and downstream of the photoconductor drum 50.

According to the implementation depicted in FIG. 2, a rotating carousel toner cartridge assembly 67 is employed containing a "black" toner developer 62, a "cyan" toner developer 162, a "magenta" toner developer 262, and a "yellow" toner developer 362. Hence, each of developers 62, 162, 262, and 362 contains a powder toner having a respective associated color for use in generating one color image plane.

A drive motor (not shown) rotates assembly 67 to present a desired developer roller 58 and toner developer 62, 162, 262, 362 (containing a desired toner reservoir 59 containing toner) against drum 50. Such rotation is controlled by microcontroller 31. Additionally, waste toner is augered into a waste reservoir (not shown) by auger 55. Auger 55 is also provided in the carousel cartridge assembly 67 for collecting waste toner that is removed by cleaner blade 54 from photoconductor drum 50, after depositing an image plane onto sheet 64 of paper. Toner cartridge assembly 67 further includes an aperture, or slot, through which optical images are delivered via imaging path 60 onto charged photoconductor drum 50. A charge roller 56 is supported in contact with drum 50 to deliver a charge to drum 50.

Preferably, toner cartridge assembly 67 is designed as a replaceable toner/developer cartridge, with color being accomplished by using multiple development stations as provided by toner developers 62, 162, 262, and 362. One color is associated with each reservoir for the subtractive colors cyan, yellow and magenta, plus black. Typically, toners are colored with either a dye or a pigment. In operation, the four colored image planes are individually accumulated onto photoconductor drum 50 and transferred onto sheet 64 of paper, before transferring a successive color image plane. In this manner, according to the present embodiment, sheet 64 of paper is passed between photoconductor drum 50 and transfer roller 52 up to four separate times.

It is understood that printer 10 works as any presently understood electrophotographic, or laser, printing process. More particularly, charge roller 56 comprises a conductive elastomer charge roller that is placed in direct contact with photoconductor drum 50. Charge roller 56 generates a charge on the surface of photoconductor drum 50. Subsequently, laser scanner 22 traces the charged photoconductor drum 50 via imaging path 60 with a wavelength of exposing light source that matches the spectra sensitivity of photoconductor drum 50. The developed photoconductor drum 50 imparts monocomponent image development by receiving powder toner onto the charged surface of photoconductor drum 50, after which such toner is delivered onto sheet 64 when such sheet 64 is passed between transfer roller 52 and photoconductor drum 50. Accordingly, monocomponent development is well understood in the art, and is carried out up to four different times in order to deliver up to four different color planes onto a single sheet 64 of paper.

The novelty of Applicant's invention lies in the manner in which a single sheet 64 of paper is repeatedly delivered in an accurate positional manner across photoconductor drum 50 when delivering successive, superposed image planes thereon.

Accordingly, the provision of paper edge detector 30 enables the accurate determination of the position of a sheet 64 of paper along the paper travel path 26 during the four electrophotographic print operations used to deliver four superposed color image planes onto sheet 64. In order to achieve precise and accurate registration between success color planes, drive roller 38 on one edge of the sheet cooperates with an associated roller 39 to maintain accurate lateral positioning of sheet 64 which further ensures superposed, aligned registration between successive transferred image planes.

It is understood that a color print is composed of at least three, and usually four, different colored image planes. The precise alignment of these image planes to one another is critical to achieving a high-quality color image being placed onto a sheet of paper. Even slight variations in placement between successive image planes can cause hue and density shifts throughout the printed page.

Pursuant to the implementation depicted in FIG. 2, four color image planes are successively imaged and transferred directly onto sheet 64 of paper in essentially the same manner as a readily understood prior art monochrome laser printer. However, a recirculating type paper drive, or paper transport mechanism, 28 is provided in printer 10 consisting of drive roller 38 and edge roller 39 which clamp sheet 64 at one margin (along one edge) at each roller transport assembly 34–37 so as to impart precise registration and delivery of such sheet of paper therebetween. The accurate positioning of sheet 64 against drum 50 during successive image transfer operations is enabled via paper edge detector 30.

In order to achieve accurate lateral alignment of sheet 64 during movement along paper travel path 26, each roller 39 (for each assembly 34–37) cooperates with each respective drive roller 38 to laterally align sheet 64. More particularly, roller 39 comprises a previously mentioned edge-guide skew roller.

Additionally, a plurality of guide tracks 70–73 are provided within housing 12. Guide tracks 70–73 serve to direct sheet 64 within housing 12 as sheet 64 travels along paper travel path 26. Each guide track is formed from one or more rigid track walls, such as walls 74–79.

A pair of paper redirection guides, or sheet diverter gates, 82 and 84 are also provided within housing 12 to further selectively redirect sheet 64. More particularly, guide 82 is activated via a solenoid to advance sheet 64 along travel path 26, and is retracted to advance sheet 64 into fuser 66 and between exit rollers 68. Exit rollers 68 can be driven in forward and reverse. Accordingly, sheet 64 can be inverted in order to print on a back-side of such sheet 64.

In order to invert sheet 64, sheet 64 is delivered to exit rollers 68 sufficiently to clear redirection guide 84. Subsequently, guide 84 is actuated via a solenoid to a raised position. Sheet 64 is then driven in reverse, guiding sheet 64 along track walls 77 and 79 and guide 84 for delivery into assembly 36. Hence, sheet 64 is delivered, in an inverted configuration, back into travel path 26. Sheet 64 is then delivered along travel path 26 via paper transport mechanism 28 to transfer one or more successive image planes onto a back side of sheet 64, as previously discussed with respect to the front side of sheet 64. Once printing is complete, sheet 64 is delivered from housing 12 via exit rollers 68.

Accordingly, the implementation depicted in FIG. 2 delivers a sheet 64 of paper from within tray 14, off a pressure plate 44 by way of a pick roller 46. Pick roller 46 cooperates with a plurality of guide rollers 48 to guide such delivered sheet of paper between edge guide skew roller 39 and paper drive roller 38 of assembly 34. Assembly 34 moves paper 64 into the nip between drive roller 38 and roller 39 for transfer along paper travel path 26.

Once a sheet 64 of paper has been delivered into the nip between each pair of-rollers 38, 39, sheet 64 is moved forward via respective motors under control of microcontroller 31, into assembly 35, and into contact with photoconductor drum 50. Hence, the sheet 64 of paper is passed between drum 50 and roller 52, after drum 50 has been charged and an image plane has been applied and a single color toner has been adhered thereto. Accordingly, full forward delivery of paper 64 during a first pass imparts such toner thereon in the form of a single color image plane, with such paper being delivered in a forward direction about path 26.

After depositing the first color image plane, sheet 64 is moved forward about path 26 until paper edge detector 30 detects the presence of a forward edge of sheet 64. Microcontroller 31 is then used to accurately drive sheet 64 forward for presentment at the nip between photoconductor 50 and transfer roller 52. While moving sheet 64 about path 26, photoconductor drum 50 is recharged, a second color image plane is applied thereon, and a second toner is applied thereto, after which sheet 64 is accurately delivered against drum 50 and paper 64 is delivered in a forward direction via drive roller 38 and roller 39 to deposit the second color image thereon and registration therewith and delivery of such paper 64 forward along path 26. Such operation is carried out two more times in order to deliver the remaining two color image planes onto paper 64.

However, prior to application of the last color image plane onto paper 64, paper redirection guide 82 is actuated to a downwardly biased position such that paper 64 is delivered into a fuser 66, comprising a pair of heated rollers that fuse the resulting colored image onto paper 64. Fuser 66 delivers such paper 64 to a pair of advancement rollers, and finally to a pair of exit rollers 68 where the printed and fused sheet 64 of paper is ejected into an output tray for retrieval by a user who has submitted a print job thereto.

As shown in FIG. 2, pick roller 46 comprises any of a number of pick roller constructions that are presently understood in the art. One exemplary pick roller construction is depicted in U.S. Pat. No. 5,462,373 to Chia, herein incorporated by reference, and illustrating construction of a heat advancement system having a roller arrangement with first and second rollers that impart in phase and out of phase rotation for engaging and gripping a sheet of paper for delivery from a stack while eliminating roller drag as such sheets pass beneath the rollers. However, it is understood that any of a number of pick roller constructions can be utilized to retrieve a sheet 64 of paper from paper tray 14 and delivery to drive roller 38 and edge roller 39 of assemblies 34–37.

Each roller 38 (provided along one lateral edge of path 26) is driven in rotation to induce movement of a sheet 64 of paper which is engaged along an edge by a respective roller 39.

Edge guide skew roller 39 comprises a pinch or pressure roller that is spring-biased into engagement with drive roller 38 via action of a spring loaded arm, on which each edge roller 39 is carried for rotatably biased engagement and co-rotation with roller 38. Preferably, roller 39 comprises a semi-resilient material such as a neoprene, nylon or plastic material.

Preferably, drive roller 38 is driven for rotation via a high-resolution stepper motor, and/or includes encoders that will ensure excellent image plane registration between successive image planes.

According to the range depicted in FIG. 2, four successive color image planes are imaged and transferred directly onto sheet 64 of paper in a manner similar to that implemented on a traditional monochrome laser printer. Utilization of the recirculating-type paper drive in the form of paper transport mechanism 28 utilizes multiple edge-guide skew rollers 39 within assemblies 34–37 in order to transport sheet 64 along opposite edges in a path circling electrophotographic (EP) print engine 20.

According to such implementation, process-wise registration of sheet 64 is established utilizing a precise slot photointerruptor provided by paper edge detector 30. Additionally, cross-process registration is maintained utilizing edge guide skew roller 39 of assemblies 34–37 which cooperates to provide an edge guide paper path.

In summary, a four-color imaging process is implemented according to the following six steps: First, a sheet 64 of paper is picked utilizing pick roller 46 from tray 14 and introduced into precise slot photointerruptor 42. Microcontroller 31 precisely establishes the path-wise location of sheet 64 by determining the exact location of the top edge of sheet 64.

Secondly, the optical photoconductive (OPC) drum 50 (or roller) is rotated and exposed by a laser of laser scanner 22 along imaging path 60, and development of a first color image plane is begun on the outer surface of drum 50. Thirdly, as the top of the first color image plane rotates into a transfer area, sheet 64 is driven in a forward direction using one or more of drive rollers 38. Accordingly, a leading edge of sheet 64 is directed into a nip between transfer roller 52 and photoconductor drum (or OPC) 50.

Pursuant to a fourth step, once a first image plane has been completely transferred, sheet 64 continues in a circular path 26 around EP print engine 20 until sheet 64 is, again, introduced into slot photointerruptor 42, precisely establishing the location of a top edge of sheet 64.

According to a fifth step, the first four steps above are repeated once for each of three remaining color planes. Finally, paper is directed into fuser 66, and all four transferred color image planes are fused simultaneously onto a first side of sheet 64. Sheet 64 is then delivered from housing 1 2 via exit roller 68. Alternatively, sheet 64 is turned upside down via exit roller 68 and paper redirection guide 84 for printing on a second, or back, side of sheet 64 via delivery about path 26 and repetition of the above steps on the second side.

Accordingly, integrated duplexing can be implemented utilizing the techniques of the present invention. As discussed above, paper redirection guide 84 is actuated by a solenoid downstream of fuser 66. Exit rollers 68 are actuated in a reverse direction to redirect sheet 64 back into the recirculating paper path 26 where the back side of sheet 64 can be subsequently printed.

Accordingly, numerous inherent advantages are provided by a recirculating-type paper drive color laser printer. The above-described recirculating-type paper drive system provides a relatively low cost, compact size, and relatively high print quality for a color laser printer. Because such printer is capable of facilitating direct-to-paper transfer, the need for a page-size belt or photoconductor drum is eliminated. According to alternative techniques, photoconductor drum 50 needs to be constructed such that the outer surface is sufficiently large so that an entire page can be built thereon when transferring four color image planes successively thereto. Accordingly, a much smaller sized photoconductor drum can be utilized which provides a relatively less expensive printer construction.

Figure 3:
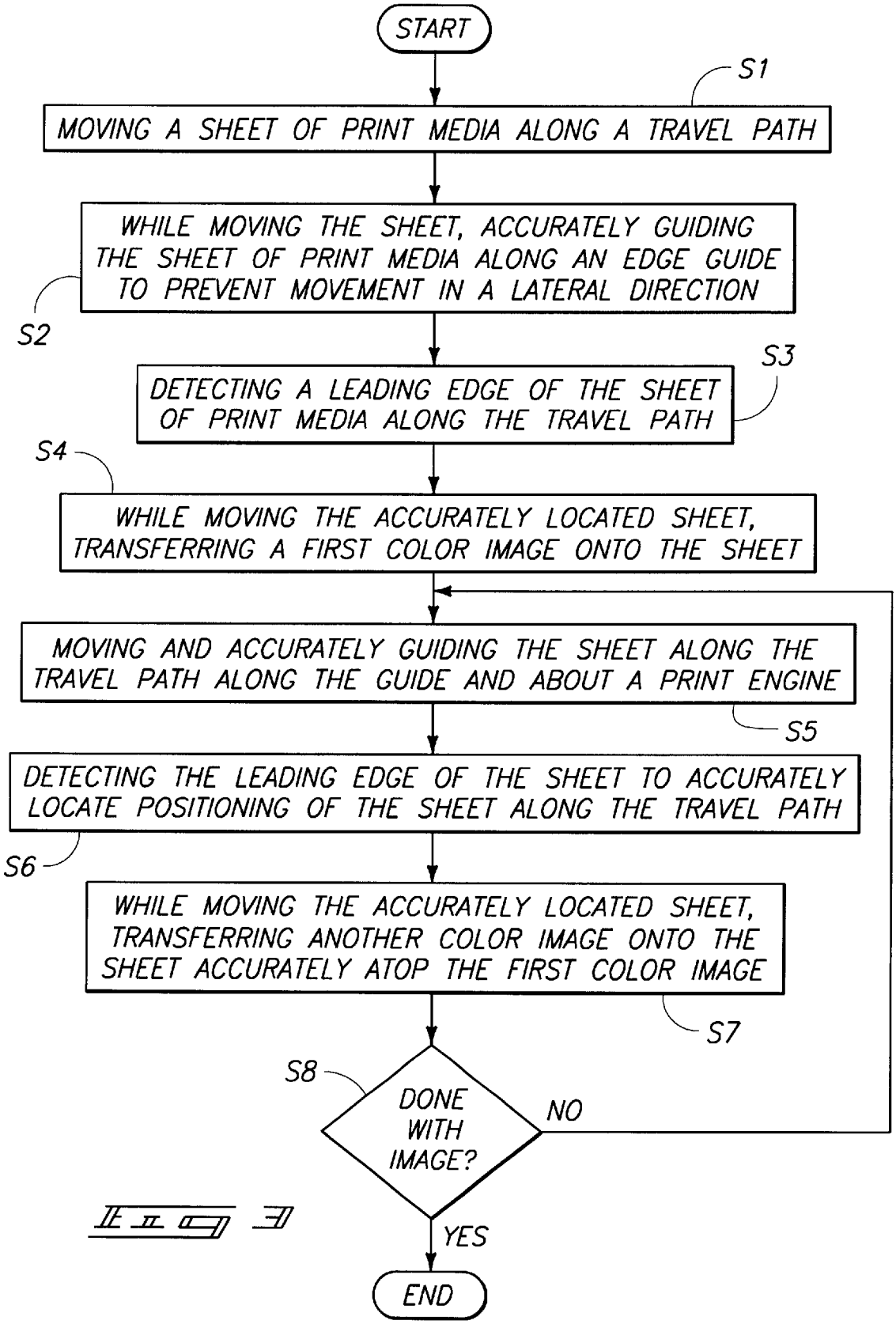
FIG. 3 is a flow chart illustrating logic employed by the paper drive system included in the printing system of FIGS. 1–2.

FIG. 3 is a flow chart illustrating logical operations employed when implementing the recirculating-type paper drive color laser printing features of Applicant's invention. In Step "S1", the method of aligning and positioning a sheet of print media to receive multiple, successive color image planes entails moving a sheet of print media along a travel path. After performing Step "S1", the process proceeds to Step "S2".

In Step "S2", the method entails moving the sheet of print media along the travel path, accurately guiding the sheet of print along an edge guide to prevent movement in a lateral direction. After performing Step "S2", the process proceeds to Step "S3".

In Step "S3", the method entails detecting the leading edge of the sheet of print media to accurately locate positioning of the sheet of print media along the travel path. After performing Step "S3", the process proceeds to Step "S4".

In Step "S4", the method entails, while moving the accurately located sheet of print media, transferring a first color image onto the sheet of print media. After performing Step "S4", the process proceeds to Step "S5".

In Step "S5", the process entails moving and accurately guiding the sheet of print media along the travel path against the edge guides and about a print engine. After performing Step "S5", the process proceeds to Step "S6".

In Step "S6", the method entails following transferring of the first color image and moving the sheet, detecting the leading edge of the sheet of print media to accurately locate positioning of the sheet of print media along the travel path. After performing Step "S6", the process proceeds to Step "S7".

In Step "S7", the method entails, while moving the accurately located sheet of print media, transferring a second color image onto the sheet of print media accurately aligned atop the first color image.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A paper drive sheet feeder system, comprising:

an edge guide including a paper drive roller and an edge-guide skew roller to guide the edge of a sheet of paper along a travel path of a peripheral device;

a paper transport mechanism configured to move the sheet of paper in a forward direction along the travel path and circumferentially about a print engine of peripheral device;

a paper edge detector provided along the travel path to detect a leading edge of the sheet of paper;

control circuitry communicating with the paper transport mechanism and the paper edge detector and operative to locate the sheet of paper in response to the detected leading edge of the sheet of paper along the travel path to accurately superpose successive image planes during a multiple color image transfer process;

a sheet guide track for redirecting a sheet of paper from the travel path back into the travel path in an inverted configuration;

a first sheet diverter gate for guiding the sheet from the travel path into the sheet guide track;

a second paper transport mechanism along the sheet guide track to selectively move the sheet in forward and reverse directions; and a second sheet diverter gate for opening the sheet guide track to receive the sheet in a forward direction and eject the sheet in a reverse direction that is in an inverted position relative to the travel path.

2. The paper drive sheet feeder system of claim 1 wherein the paper transport mechanism comprises a plurality of edge-guide skew rollers configured to transport the sheet of paper by accurately guiding the sheet of paper along the travel path.

3. The paper drive sheet feeder system of claim 1 wherein the edge guide comprises a pair of adjacent flanges cooperating to retain and guide one edge of the sheet of paper therebetween, and wherein the travel path encircles the print engine.

4. The paper drive sheet feeder system of claim 1 wherein the paper edge detector comprises a slot photointerruptor.

5. The paper drive sheet feeder system of claim 4 wherein the slot photointerruptor comprises an optical photodetector and a light source each provided on opposite sides of the travel path, the optical photodetector operative to detect the light source, wherein presence of one of the leading edge of the sheet of paper causes a change in state of the detected light source corresponding with movement of the sheet of paper through an optical detection path of the optical photodetector.

6. The paper drive sheet feeder system of claim 1 further comprising a sheet diverter gate operative to invert the sheet of paper along the paper travel path for duplex imaging.

7. A printing system for printing multiple colors on a sheet of print media, comprising:

an electrophotographic print engine including a photoconductor drum and a transfer roller configured to interact in coacting rotation with the drum during transfer of a color image plane from the drum onto a sheet of print media passed therebetween; and a paper drive sheet feeder system having at least one edge guide to guide an edge of the sheet of print media along a travel path about the print engine, a sheet transport mechanism configured to move the sheet of print media along the travel path and circumferentially about a print engine of the printing system, a sheet edge detect or provided along the travel path to detect the leading edge of the sheet of print media, and control circuitry communicating with the sheet transport mechanism and the sheet edge detector and operative to locate the sheet of print media in response to the detected leading edge of the sheet of print media along the travel path t o accurately superpose successive image planes during a multiple color image transfer process.

8. The printing system of claim 7 wherein the at least one edge guide comprises edge-guide skew rollers cooperating to transport the sheet of print media by accurately guiding the sheet of print media along an edge for transport along the travel path.

9. The printing system of claim 7 wherein the sheet edge detector comprises a light source provided along a first side of the sheet travel path and a photodetector along a second side of the sheet travel path configured to detect light from the light source, wherein movement of the sheet of print media along the travel path interrupts the beam so as to provide a detectable change at the photodetector corresponding to presence of a leading edge of the sheet of print media.

10. The printing system of claim 9 wherein the sheet edge detector comprises a slot photointerruptor interposed across the sheet travel path.

11. The printing system of claim 7 wherein process-wise registration is provided by the sheet edge detector, and wherein cross-process registration is provided by an edge guide.

12. The printing system of claim 7 further comprising a sheet diverter gate downstream of a fuser and operative to redirect the sheet into the travel path upside down and in an opposite direction so as to provide duplex image transfer.

13. A method of aligning and positioning a sheet of print media to receive multiple, successive color image planes, the method comprising:

moving a sheet of print media along a travel path in a first direction;

while moving the sheet of print media along the travel path, accurately guiding the sheet of print media along an edge guide to prevent movement in a lateral direction;

detecting the leading edge of the sheet of print media to accurately locate positioning of the sheet of print media along the travel path;

while moving the accurately located sheet of print media, transferring a first color image onto the sheet of print media;

moving and accurately guiding the sheet of print media along the travel path along the guide and about a print engine;

following transferring the first color image and moving the sheet, detecting the leading edge of the sheet of print media to accurately locate positioning of the sheet of print media along the travel path;

while moving the accurately located sheet of print media, transferring a second color image onto the sheet of print media accurately aligned atop the first color image;

moving the sheet of print media from the travel path into a sheet guide track that inverts the sheet;

inverting the sheet of print media; and moving the inverted sheet of print media from the sheet guide track to the travel path to present an opposed surface of the sheet of print media to receive an image plane.

14. The method of claim 13 wherein, after transferring the first color image, the steps of moving and accurately guiding, detecting, and transferring are carried out three times in series to transfer the second color image, a third color image, and a fourth color image successively and accurately aligned atop the first color image so as to accurately register four color images atop the sheet of print media.

15. The method of claim 13 wherein accurately guiding the sheet of print media along the guide to prevent movement in a lateral direction comprises moving the sheet of print media between a pair of edge-guide skew rollers operative to transport the sheet of print media along an edge in a path circling an electrophotographic print engine.

16. The method of claim 13 wherein the initial step of moving the sheet of print media along a guide and along a travel path comprises picking the sheet of media from a paper tray and moving the sheet of media into a slot photointerruptor.

17. The method of claim 16 wherein detecting the leading edge of the sheet of print media to accurately locate positioning of the sheet of print media along the travel path comprises detecting movement of the sheet of media into the slot photointerruptor.

18. The method of claim 17 wherein the slot photointerruptor comprises a light source and a photodetector provided on opposite sides of the paper travel path such that movement of the sheet of media between the light source and the photodetector interrupts detection of a light beam from the light source by the photodetector.

19. The method of claim 18 wherein a change in state of detection of the light source corresponds with the leading edge of the sheet of media.

* * * * *

UNITED STATES PATENT AND TRADEMARK OFFICE

CERTIFICATE OF CORRECTION

PATENT NO. : 6,484,008 B2
DATED : November 19, 2002
INVENTOR(S) : David J. Arcaro et al.

It is certified that error appears in the above-identified patent and that said Letters Patent is hereby corrected as shown below:

Column 12,
Line 28, delete "detect or" and insert therefor -- detector --
Line 34, delete "t" and insert therefor -- to --
Line 35, delete "o"

Signed and Sealed this

Twenty-sixth Day of July, 2005

JON W. DUDAS
*Director of the United States Patent and Trademark Office*